US009469498B2

(12) United States Patent
Harris

(10) Patent No.: US 9,469,498 B2
(45) Date of Patent: Oct. 18, 2016

(54) GARDEN HOSE HOLDER

(71) Applicant: Cindy Ann Harris, Huntersville, NC (US)

(72) Inventor: Cindy Ann Harris, Huntersville, NC (US)

( * ) Notice: Subject to any disclaimer, the term of this patent is extended or adjusted under 35 U.S.C. 154(b) by 0 days.

(21) Appl. No.: 14/300,914

(22) Filed: Jun. 10, 2014

(65) Prior Publication Data

US 2014/0367533 A1 Dec. 18, 2014

Related U.S. Application Data

(60) Provisional application No. 61/834,489, filed on Jun. 13, 2013.

(51) Int. Cl.
*B05B 15/06* (2006.01)
*B65H 75/36* (2006.01)

(52) U.S. Cl.
CPC ..... *B65H 75/366* (2013.01); *B65H 2701/33* (2013.01)

(58) Field of Classification Search
CPC B65H 75/366; B65H 2071/33; A62C 33/04; A62C 33/00
USPC ..... 248/301, 75, 90, 303
See application file for complete search history.

(56) References Cited

U.S. PATENT DOCUMENTS

| | | | | |
|---|---|---|---|---|
| 355,924 | A | 1/1887 | Favel | |
| 533,826 | A | 2/1895 | Now | |
| 603,207 | A | 4/1898 | Ruby | |
| 741,922 | A | 10/1903 | Muldoon | |
| 37,306 | A | 1/1905 | Gibbs | |
| 955,260 | A | 4/1910 | Getman | |
| 1,112,744 | A | 10/1914 | Weh | |
| 1,284,022 | A | 11/1918 | Wright | |
| 2,453,248 | A | 11/1948 | Much | |
| 2,899,154 | A * | 8/1959 | Zavolner | A47F 7/0057 248/316.1 |
| 3,029,933 | A | 4/1962 | Sutter | |
| D207,246 | S | 3/1967 | Shames | |
| 3,638,890 | A | 2/1972 | Burrell et al. | |
| D243,488 | S | 3/1977 | Linse | |
| 4,436,267 | A | 3/1984 | Eads et al. | |
| D274,487 | S | 7/1984 | Eads et al. | |
| 4,836,479 | A | 6/1989 | Adams | |
| 4,903,922 | A | 2/1990 | Harris, III | |
| 5,005,790 | A * | 4/1991 | Harris, III | B65H 75/366 248/213 |
| 5,419,362 | A | 5/1995 | Blackaby | |

(Continued)

FOREIGN PATENT DOCUMENTS

| | | |
|---|---|---|
| DE | 398026 C | 7/1924 |
| EP | 2 674 077 A1 | 12/2013 |

(Continued)

*Primary Examiner* — Christopher E Garft
(74) *Attorney, Agent, or Firm* — Seth L. Hudson; Clements Bernard, PLLC

(57) ABSTRACT

The present invention provides methods and systems for a garden hose holder that includes a base having a first rail and a second rail that form a substantially vertical upper portion and intersect at a neck portion, a substantially horizontal center portion, and a substantially vertical lower portion. An arcuate support device is engaged to the first rail and second rail at the center portion, whereby the first rail and the second rail intersect extend outwardly at an angle from the neck portion forming the upper portion, the first rail and second rail extend outward from the upper portion in a generally parallel fashion forming the center portion and lower portion of the base.

17 Claims, 3 Drawing Sheets

(56) References Cited

U.S. PATENT DOCUMENTS

| | | | | |
|---|---|---|---|---|
| 5,634,615 | A | 6/1997 | Shuen | |
| 5,897,002 | A * | 4/1999 | Carlino | B25H 3/04 211/106 |
| 5,988,570 | A | 11/1999 | Gretz | |
| 6,059,215 | A | 5/2000 | Finnis | |
| 6,079,675 | A * | 6/2000 | Hsu | B65G 7/12 248/68.1 |
| D438,022 | S * | 2/2001 | Bunn | D6/317 |
| D462,254 | S | 9/2002 | Wright et al. | |
| 6,708,934 | B2 | 3/2004 | Brueske | |
| 7,427,053 | B2 * | 9/2008 | Nawrocki | A47F 5/0006 211/57.1 |
| D646,960 | S * | 10/2011 | Goodman | D8/372 |
| 8,272,610 | B2 * | 9/2012 | Ernst | A47L 13/16 211/106 |
| 8,596,601 | B1 * | 12/2013 | Andersen | F16M 13/02 211/96 |
| 2002/0074462 | A1 | 6/2002 | Pontecorvo | |
| 2003/0029820 | A1 * | 2/2003 | Heneveld, Sr. | A47B 46/005 211/87.01 |
| 2011/0303804 | A1 * | 12/2011 | Rodrigues | G10G 5/00 248/122.1 |

FOREIGN PATENT DOCUMENTS

| | | | |
|---|---|---|---|
| FR | 2 220 734 | A1 | 10/1974 |
| FR | 2 559 045 | A1 | 8/1985 |
| GB | 123222 | | 2/1919 |
| JP | 11-156086 | A | 6/1999 |
| JP | 11-246000 | A | 9/1999 |
| JP | 3057052 | B2 | 9/1999 |
| JP | 2011-167141 | A | 9/2011 |
| JP | 2013-146503 | A | 8/2013 |
| KR | 10-2011-0048697 | A | 5/2011 |

* cited by examiner

GARDEN HOSE HOLDER

CROSS REFERENCE TO RELATED PATENT APPLICATION

The current application claims the benefit of the earlier priority filing date of provisional application Ser. No. 61/834,489 that was filed on Jun. 13, 2013 and entitled "REMOVABLE GARDEN HOSE HOLDER", the contents of which are incorporated by reference herein.

FIELD OF THE INVENTION

The present invention relates generally to a removable garden hose holder, and more generally relates to a garden hose holder that is removably mounted to an outdoor spigot.

BACKGROUND OF THE INVENTION

Garden hoses are used by many households to transport water from an outdoor spigot to water plants and grass, or wash automobiles and pets. The garden hose is extremely long and unsightly if left in the extended position on the driveway, patio, or grass. Most households purchase a device that stores the garden hose, which is usually bulky and unsightly. These devices are large, obtrusive, and expensive. The devices may be free standing or attached to the side of the residence with screws that penetrate the exterior of the residence.

There is a need for a holder that is simple to use, but effective in storing the garden hose. The present invention satisfies this need and allows the hose to be properly stored and the holder to be easily installed and removed from the outdoor spigot.

BRIEF SUMMARY OF THE INVENTION

According to an embodiment of the present invention, a garden hose holder includes a base having an upper portion with a neck portion, a center portion, and a lower portion. The holder includes a first rail and a second rail, whereby the first rail and the second rail intersect at the neck portion and extend outwardly from the neck portion forming the upper portion, the first rail and second rail extend outward from the upper portion in a generally parallel fashion forming the center portion and lower portion of the base.

According to another embodiment of the present invention, a garden hose holder includes an upper portion that is substantially A-shaped.

According to yet another embodiment of the present invention, a garden hose holder includes a generally cylindrical first rail and a generally cylindrical second rail that are spaced apart from each other and intersect at the neck of the upper portion.

According to yet another embodiment of the present invention, a garden hose holder includes a protective element engaged to the center portion and the lower portion of the base.

According to yet another embodiment of the present invention, a garden hose holder includes a support device engaged to the base.

According to yet another embodiment of the present invention, a garden hose holder includes a coupler having an upper portion and a lower portion, whereby the upper portion is engaged to an outdoor spigot and the lower portion is engaged to the base.

According to yet another embodiment of the present invention, a garden hose holder includes an arcuate support device engaged to the center portion of the base.

According to yet another embodiment of the present invention, a garden hose holder includes compressible foam engaged to the center portion.

According to yet another embodiment of the present invention, a garden hose holder includes a base having a substantially vertical upper portion with a neck portion, a substantially horizontal center portion, a substantially vertical lower portion, and a first rail and second rail. The first rail and the second rail intersect at the neck portion and extend outwardly at an angle from the neck portion forming the upper portion, the first rail and second rail extend outward from the upper portion in a generally parallel fashion forming the center portion and lower portion of the base.

According to yet another embodiment of the present invention, a garden hose holder is composed of metal.

According to yet another embodiment of the present invention, a garden hose holder includes a generally cylindrical first rail and a generally cylindrical second rail that are spaced apart from each other and intersect at the neck of the upper portion.

According to yet another embodiment of the present invention, a garden hose holder includes a first rail and second rail angled towards each other at the lower portion.

According to yet another embodiment of the present invention, a garden hose holder contains a support device containing a plurality of holes.

According to yet another embodiment of the present invention, a garden hose holder contains a coupler having an upper portion and a lower portion, whereby the upper portion is engaged to an outdoor spigot and the lower portion contains a lip that engages the neck portion of the upper portion of the base.

According to yet another embodiment of the present invention, a garden hose holder that includes a base having a first rail and a second rail that form a substantially vertical upper portion and intersect at a neck portion, a substantially horizontal center portion, and a substantially vertical lower portion. An arcuate support device is engaged to the first rail and second rail at the center portion, whereby the first rail and the second rail intersect extend outwardly at an angle from the neck portion forming the upper portion, the first rail and second rail extend outward from the upper portion in a generally parallel fashion forming the center portion and lower portion of the base.

According to yet another embodiment of the present invention, a garden hose holder includes at least one hole in the upper portion for receiving an attachment means.

BRIEF DESCRIPTION OF THE DRAWINGS

The present invention is illustrated and described herein with reference to the various drawings, in which like reference numbers denote like method steps and/or system components, respectively, and in which.

DETAILED DESCRIPTION OF THE INVENTION

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
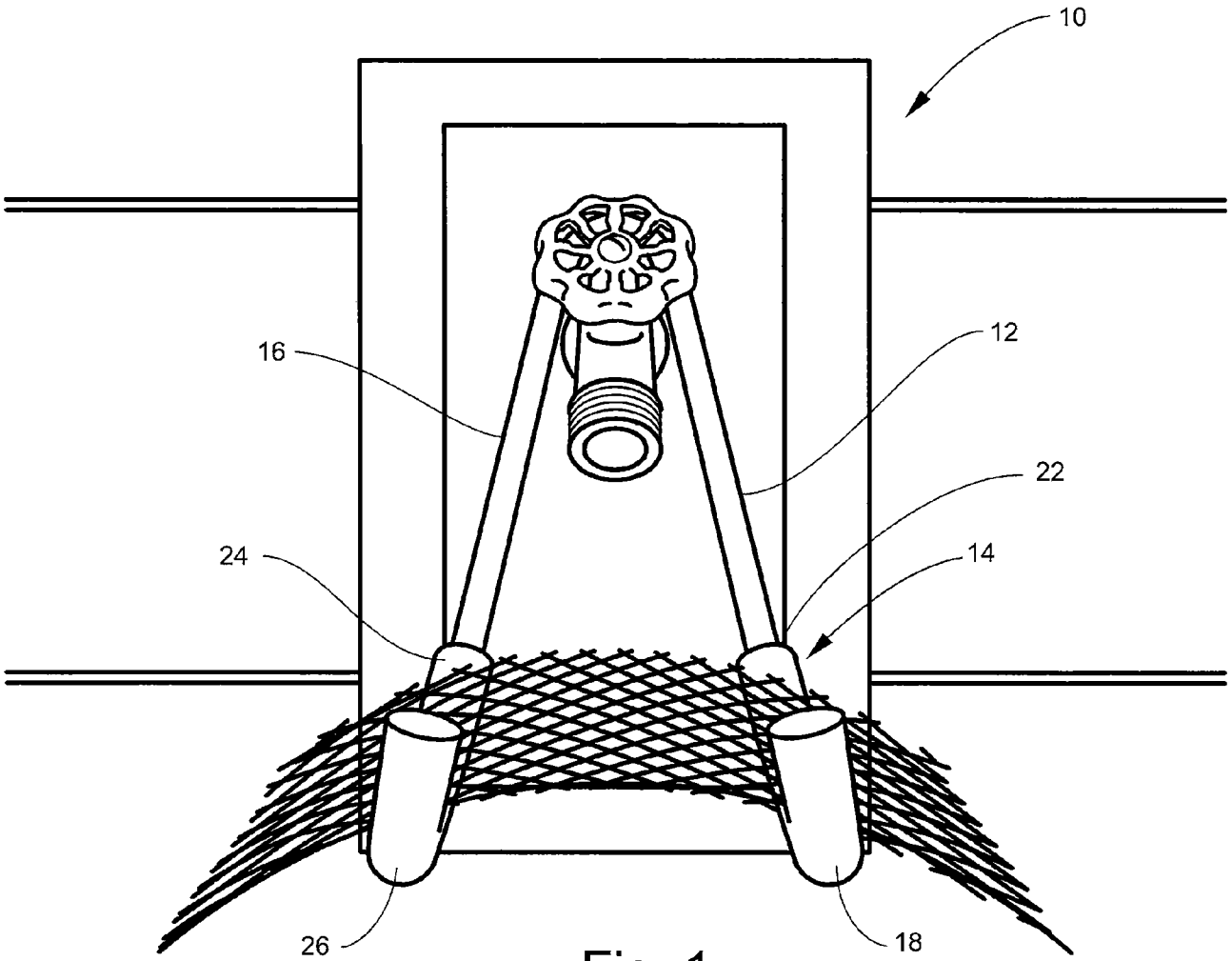
FIG. 1 is a perspective view of one embodiment of the invention.

Referring now specifically to the drawings, a removable garden hose holder is illustrated in FIG. 1 and is shown generally at reference numeral 10. The holder 10 contains a base 12 that is designed to be selectively secured to an outdoor spigot. The base 12 of the holder 10 has a center portion 14, an upper portion 16, and a lower portion 18.

The upper portion 16 of the base 12 is generally A-shaped and angled upwards from center portion 14. The neck 20 is designed to be selectively secured to the back end of the spigot behind the handle, and designed not to impair or interrupt the operation of the handle 10. A first rail 22 and second rail 24 extend downwardly from the neck 20 in the vertical direction. The first rail 16 and second rail 20 are in a spaced-apart arrangement, and the spacing gradually increases from the neck 20 to the center portion.

As illustrated in FIG. 1, the center portion 14 is substantially flat and when placed upon a spigot will be aligned substantially horizontal to grade. The upper portion 16 is substantially vertical and the lower portion 18 may be substantially vertical. The upper portion 16 consists of the neck 20 with the first rail 22 and second rail 24 extending therefrom in an A-shaped formation, meaning the first rail 22 and second rail 24 extend away from the neck 20 and angled outward in opposite directions. The first rail 22 and second rail 24 are substantially parallel within the center portion 16 and lower portion 18.

Figure 2:
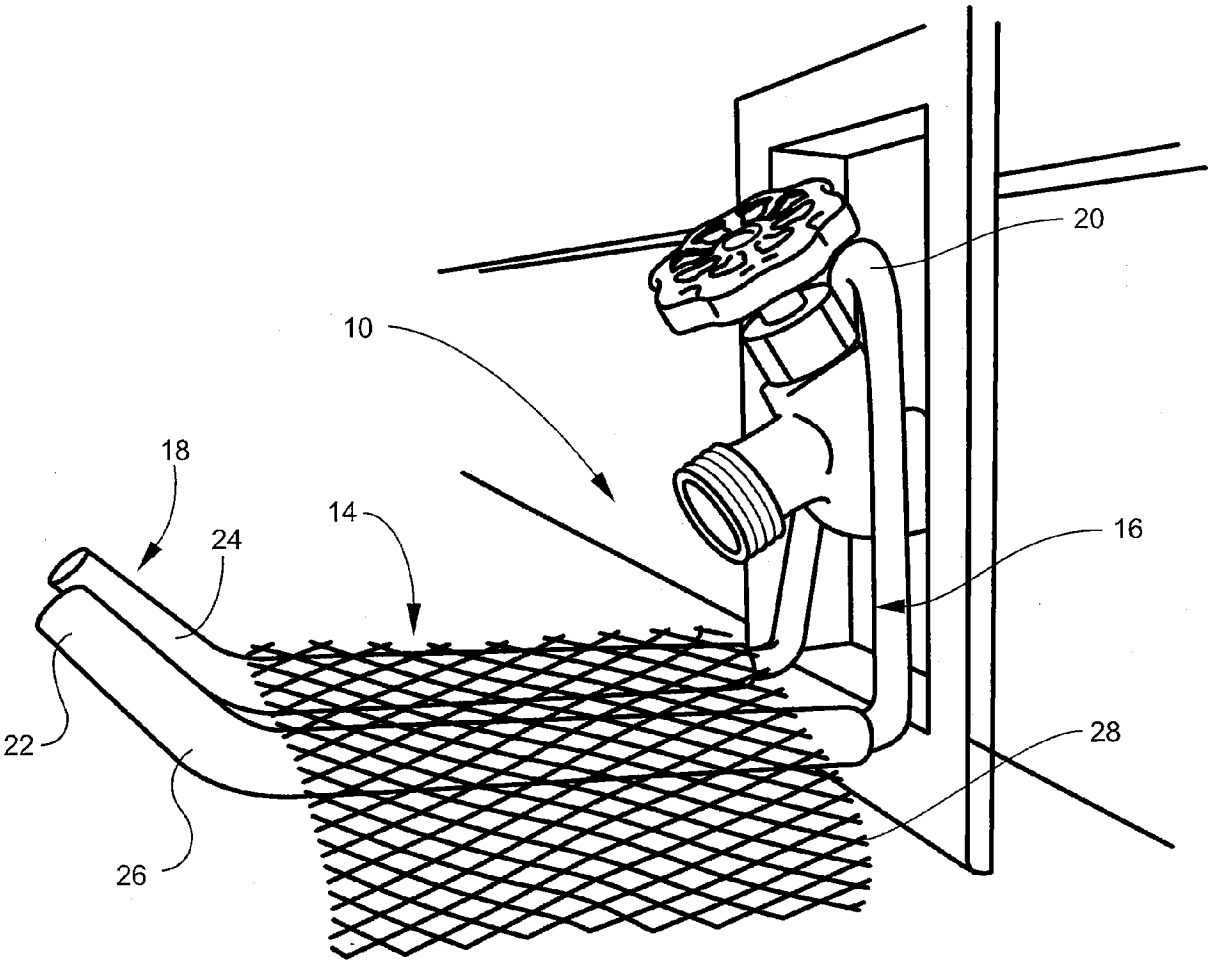
FIG. 2 is a side perspective view of one embodiment of the invention.
Figure 3:
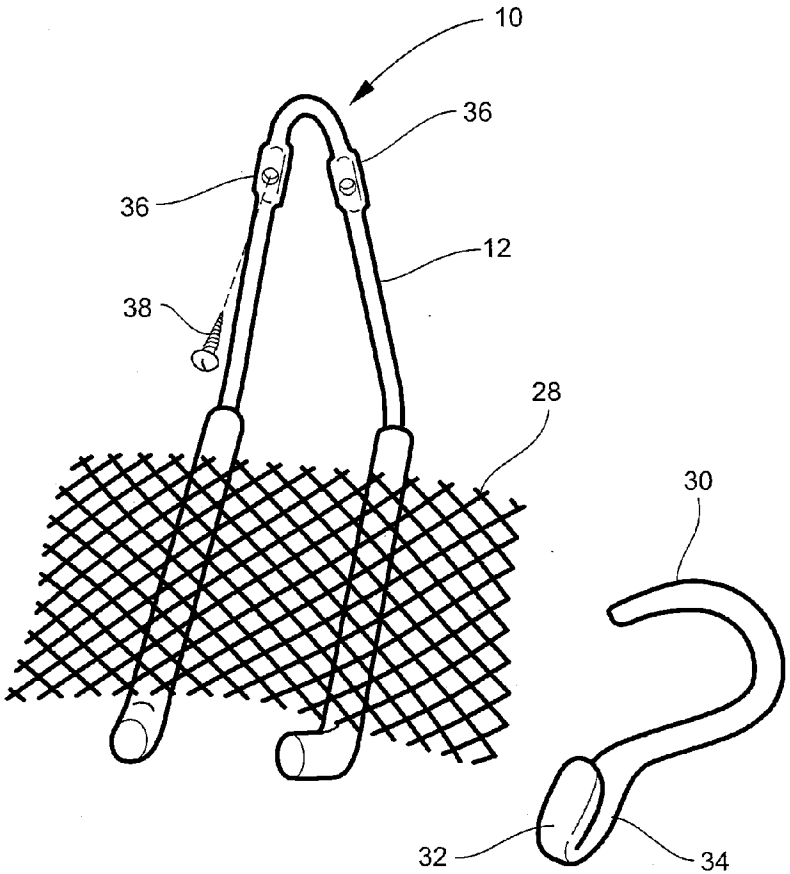
FIG. 3 is a perspective view of another embodiment of the invention.

The first rail 22 and second rail 24 extend substantially vertically downward in the upper portion and extends horizontally at the junction between the upper portion and the center portion. When the holder 10 is placed on a spigot, the center portion extends away from the residence. The first rail 22 and second rail 24 of the center portion 14 are generally equally, spaced apart from one another. The lower portion 18 consists of the first rail 22 and second rail 24 extending generally upward or vertically from the center portion. As illustrated in FIGS. 1-3, the lower portion 18 extends upward at an angle of about 45° from the center portion 14.

The first rail 22 and second rail 24 may be generally cylindrical in shape. Alternatively, the first rail 22 and second rail 24 may be generally square, flat, or the like. However, the first rail 22 and second rail 24 may be any shape as desired by the user. The base 12 may be composed of metal, plastic, wood or the like. However, the base 12 may be composed of any material desired by the user.

The first rail 22 and second rail 24 of the center portion 14 and lower portion 18 may contain an optional protective element 26. The protective element 26 may also be composed of a compressible foam. Alternatively, the protective element 26 may be contained solely on either the lower portion 18 or the center portion 14. In yet another alternative embodiment, the protective element 26 may be contained on the upper portion 16, center portion 14, and lower portion 18 of the base 12. The protective element 26 may be composed of plastic, foam rubber, or the like.

As illustrated in FIG. 2, a support device 28 may be engaged to the center portion of the base 12. The purpose of the support device 28 is to provide a support structure that has a greater surface area than the first rail 22 and second rail 24 for placement of a garden hose. The support device 28 is an optional addition. The support device 28 can be a solid support having a front surface and a back surface, whereby the back surface is engaged to the first rail 22 and second rail 24 and the front surface faces upwards for receiving a portion of the hose. The support device 28 may have an arcuate shape and extends between the first rail 22 and second rail 24 with the first end of the support device 28 extending past the first rail 22 and the second end of the support device 28 extending past the second rail 24. As illustrated, the support device 28 may contain a plurality of holes. The plurality of holes are generally diamond shape that cover the entire support device and are spaced an equal distance apart in the lateral and the longitudinal direction.

In another embodiment, a coupler 30 may be utilized for selectively securing the base 12 to the outdoor spigot. The coupler 30 generally has an upper portion and a lower portion, as illustrated in FIG. 3. The upper portion of the coupler 30 has a hook-like shape for placement around the spigot and behind the handle of the spigot. The bottom portion of the coupler 30 has an attachment means 32 for engaging the coupler 30 to the base 12. As illustrated, the attachment means 32 contains a lip 34 for engaging the neck 20 of the base 12.

Figure 4:
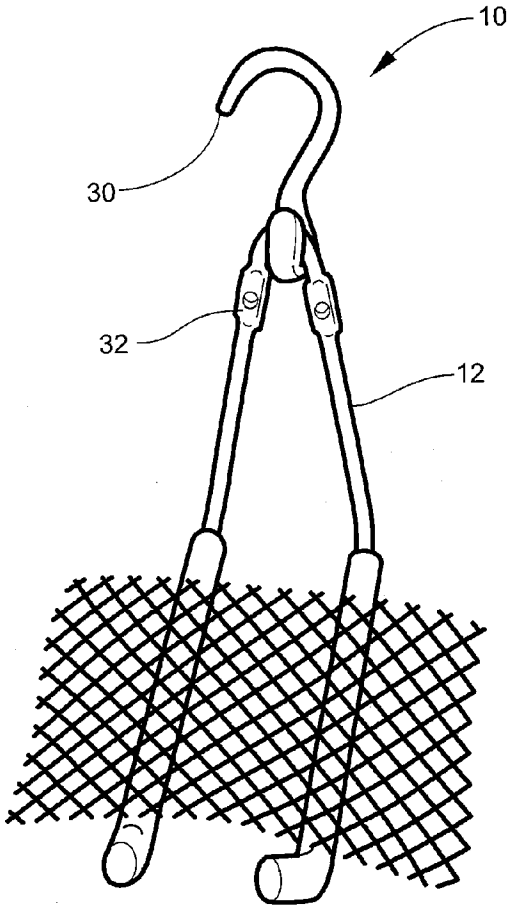
FIG. 4 is a perspective view of another embodiment of the invention.

During use, the neck 20 of the base 12 is placed over the outdoor spigot and suspended on the spigot. As illustrated in FIG. 4, the garden hose is wrapped around base 12 and supported on the center portion 14 of the base 12. The garden hose is further supported on either side of the garden hose roll by the upper portion 16 and lower portion 18. The support device 28 provides support and assists in wrapping the garden hose around the base 12. Alternatively and as also illustrated in FIG. 4, the upper portion of the coupler 30 is placed over the outdoor spigot and suspended on the spigot. The base 12 of the holder 10 is engaged to the attachment means 28 of the coupler 26. The garden hose is wrapped around base 12 and supported on the center portion of the base 12. The garden hose is further supported on either side of the garden hose roll by the upper portion 16 and lower portion 18. The support device 28 provides support and assists in wrapping the garden hose around the base 12.

The upper portion 16 may contain at least one hole 36 for receiving an attachment means for securing the holder 10 to a wall or the like. As illustrated, the upper portion 16 contains two holes 36, one on the first rail 22 and one on the second rail 24, for receiving an attachment means for securing the holder 10 to a wall or the like. Alternatively, the device 10 is hung by the neck 20 over a spigot or water pipe for providing support and allowing the device 10 to be easily removed.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention and are intended to be covered by the following claims.

What is claimed is:

1. A garden hose holder for placement around a spigot, comprising:

a base having an upper portion with a neck portion, a center portion, and a lower portion;

the upper portion, center portion, and the lower portion have a first rail and second rail;

the center portion and lower portion are wrapped in foam rubber;

a support device with a first end and a second end having an arcuate shape and containing a plurality of diamond shaped holes;

whereby the first rail and the second rail intersect at the neck portion that is placed around a spigot and the first rail and the second rail extend outwardly from the neck portion forming the upper portion, the first rail and second rail extend outwardly from the upper portion in a generally parallel fashion forming the center portion that is substantially 90 degrees to the upper portion.

2. The garden hose holder of claim 1, wherein the upper portion that is substantially A-shaped.

3. The garden hose holder of claim 1, wherein the first rail and the second rail are generally cylindrical and spaced apart from each other and intersect at the neck of the upper portion.

4. The garden hose holder of claim 1, further comprising a support device engaged to the base.

5. The garden hose holder of claim 1, further comprising a coupler having an upper portion and a lower portion, whereby the upper portion is engaged to an outdoor spigot and the lower portion is engaged to the base.

6. The garden hose holder of claim 1, further comprising a compressible foam engaged to the center portion.

7. A garden hose holder, comprising:

a base having a substantially vertical upper portion with a neck portion, a substantially horizontal center portion, and a substantially vertical lower portion; and the upper portion, horizontal portion, and the lower portion have a first rail and second rail;

a support device with a first end and a second end having an arcuate shape and containing a plurality of holes that cover the entire support device and are spaced an equal distance apart in a lateral and a longitudinal direction and the support device is disposed between the first rail and second rail on the horizontal center portion, whereby the first end extends past the first rail and the second end extends past the second rail;

whereby the first rail and the second rail intersect at the neck portion and extend outwardly at an angle from the neck portion forming the upper portion, the first rail and second rail extend outward from the upper portion in a generally parallel fashion and substantially 90 degrees from the upper portion and forming the center portion and the lower portion of the base that extends upwards and away from the center portion at an angle of substantially 45 degrees.

8. The garden hose holder of claim 7, wherein the holder is composed of metal.

9. The garden hose holder of claim 7, wherein the first rail and the second rail are generally cylindrical and spaced apart from each other and intersect at the neck of the upper portion.

10. The garden hose holder of claim 7, wherein the first rail and the second rail of the lower portion are angled towards each other.

11. The garden hose holder of claim 7, further comprising a coupler having an upper portion and a lower portion, whereby the upper portion is engaged to an outdoor spigot and the lower portion is engaged to the base.

12. The garden hose holder of claim 7, further comprising a coupler having an upper portion and a lower portion, whereby the upper portion is engaged to an outdoor spigot and the lower portion contains a lip that engages the neck portion of the upper portion of the base.

13. A garden hose holder, comprising:

a base having a first rail and a second rail that form a substantially vertical upper portion and intersect at a neck portion, a substantially horizontal center portion, and a substantially vertical lower portion; and the center portion and lower portion are wrapped in foam rubber;

a support device with a first end and a second end having an arcuate shape and containing a plurality of generally diamond shaped holes that cover the entire support device and are spaced an equal distance apart in a lateral and a longitudinal direction and the support device is disposed between the first rail and second rail on the horizontal center portion, whereby the first end extends past the first rail and the second end extends past the second rail;

whereby the first rail and the second rail intersect extend outwardly at an angle from the neck portion forming the upper portion, the first rail and second rail extend outward from the upper portion in a generally parallel fashion forming the center portion and lower portion of the base.

14. The garden hose holder of claim 13, further comprising at least one hole in the upper portion for receiving an attachment means.

15. The garden hose holder of claim 13, wherein the support device contains a plurality of holes.

16. The garden hose holder of claim 13, further comprising a coupler having an upper portion and a lower portion, whereby the upper portion is engaged to an outdoor spigot and the lower portion contains a lip that engages the neck portion of the upper portion of the base.

17. The garden hose holder of claim 13, further comprising protective element engaged to the center portion.

* * * * *